US011278906B2

(12) United States Patent
Azzolin et al.

(10) Patent No.: US 11,278,906 B2
(45) **Date of Patent: *Mar. 22, 2022**

(54) CRUSHER BUCKET WITH JAWS

(71) Applicant: MECCANICA BREGANZESE S.P.A in breve MB S.P.A., Fara Vicentino (IT)

(72) Inventors: Diego Azzolin, Breganze (IT); Guido Azzolin, Breganze (IT)

(73) Assignee: MECCANICA BREGANZESE S.P.A. IN BREVE MB S.P.A., Fara Vicentino (IT)

( * ) Notice: Subject to any disclaimer, the term of this patent is extended or adjusted under 35 U.S.C. 154(b) by 207 days.

This patent is subject to a terminal disclaimer.

(21) Appl. No.: 15/742,965

(22) PCT Filed: Jul. 11, 2016

(86) PCT No.: PCT/IB2016/054137

§ 371 (c)(1),
(2) Date: Jan. 9, 2018

(87) PCT Pub. No.: WO2017/006300

PCT Pub. Date: Jan. 12, 2017

(65) Prior Publication Data

US 2018/0221885 A1 Aug. 9, 2018

(30) Foreign Application Priority Data

Jul. 9, 2015 (IT) ..... 102015000032679

(51) Int. Cl.
*B02C 1/04* (2006.01)
*E02F 3/40* (2006.01)
(Continued)

(52) U.S. Cl.
CPC ..... *B02C 1/04* (2013.01); *B02C 1/025* (2013.01); *E02F 3/401* (2013.01); *E02F 3/3604* (2013.01)

(58) Field of Classification Search
CPC .. B02C 1/00; B02C 1/02; B02C 1/025; B02C 1/04; B02C 1/043; B02C 1/046; B02C 1/06; B02C 1/08; B02C 1/10
(Continued)

(56) References Cited

U.S. PATENT DOCUMENTS 2,605,051 A * 7/1952 Bogie ..... B02C 1/04 241/217
3,684,332 A * 8/1972 Benson ..... B02C 4/32 384/256

(Continued)

FOREIGN PATENT DOCUMENTS

DE 202015003565 U1 6/2015
EP 2564929 A2 3/2013

(Continued)

OTHER PUBLICATIONS

Xcentric Crusher bucket—XC30, XcentricRipper, Mar. 27, 2015, Youtube, https://www.youtube.com/watch?v=QKiea_9t9fw (Year: 2015).*

(Continued)

*Primary Examiner* — Faye Francis
(74) *Attorney, Agent, or Firm* — Kristina Castellano; Castellano PLLC

(57) ABSTRACT

A crusher bucket comprising a casing in which there are mounted crushing means comprising a fixed jaw and a movable jaw, in which the movable jaw is supported on the casing by means of a pair of eccentric shafts, wherein at least one of the eccentric shafts is directly fixed to the side walls of the casing.

12 Claims, 16 Drawing Sheets

(51) Int. Cl.
*B02C 1/02* (2006.01)
*E02F 3/36* (2006.01)

(58) Field of Classification Search
USPC .... 241/101.74, 101.75, 264, 267, 69, 101.2, 241/101.73, 266
See application file for complete search history.

(56) References Cited

U.S. PATENT DOCUMENTS 4,248,390 A * 2/1981 Toole ..... B02C 1/06 241/263
4,382,560 A * 5/1983 Toole ..... B02C 1/06 241/101.2
6,015,107 A * 1/2000 Stegmeier ..... B02C 4/02 241/101.2
8,322,643 B2 * 12/2012 Gervais ..... B02C 1/10 241/101.742
10,344,448 B2 * 7/2019 Azzolin ..... E02F 7/06
2004/0050987 A1 3/2004 Rossi
2012/0132739 A1 * 5/2012 Pusheck ..... B02C 4/32 241/220
2015/0352555 A1 * 12/2015 Svensson ..... B02C 1/02 241/268

FOREIGN PATENT DOCUMENTS

JP H1128373 A 2/1999
JP H1133420 A 2/1999
SU 579007 A1 * 11/1977 ..... B02C 1/04
WO 2010/103557 A1 9/2010

OTHER PUBLICATIONS

International Search Report in PCT/IB2016/054137, dated Oct. 18, 2016.
Written Opinion in PCT/IB2016/054137, dated Oct. 18, 2016.

* cited by examiner

CRUSHER BUCKET WITH JAWS

CROSS REFERENCE TO RELATED APPLICATIONS

This application is a U.S. National Stage Application of International Patent application PCT/IB2016/054137 filed on Jul. 11, 2016, which claims priority to Italian patent application 102015000032679 filed on Jul. 9, 2015, the contents of both of which are incorporated herein by reference.

DESCRIPTION

The present invention relates to an improved crusher bucket, in particular for crushing inert material, processing waste and demolition material, hereinafter generally referred to as crushed stone, according to the preamble of the main claim.

In the technical field being referred to, there are known buckets which comprise an outer casing which is configured to collect crushed stone and inside which there are mounted crushing means for the collected material.

It may be noted that, in this context, the term "bucket" is intended to be understood generally to indicate any member which is provided for being and intended to be engaged at the free end of an arm of an operating machine.

The crushing means which are provided in the casing typically comprise a pair of jaws which face each other, one movable with respect to the other in order to compress and crush the material present therebetween.

On the basis of one of the known configurations, the bucket comprises a first jaw which is positioned on the base of the bucket and which is connected in a fixed manner to the casing and a second jaw which is connected to a pair of rotatable eccentric shafts.

In this manner, the movable jaw carries out pivoting movements with respect to the fixed jaw, carrying out the crushing of the material which is interposed between the two casings.

The eccentric shafts are fixed to the casing by means of a support structure which is fixed to an upper wall thereof which faces a fixing plate which is intended for connecting the bucket to the arm of the operating machine, as schematically illustrated in FIG. 1.

However, those known buckets have the disadvantage of not being capable of withstanding the stresses which are produced by the resistance of the material to be crushed. This may involve significant technical problems in the structure of the crusher bucket.

Therefore, the technical problem addressed by the present invention is to provide a crusher bucket which allows the disadvantages mentioned above to be overcome and which is structurally and functionally configured to overcome the disadvantages set out above with reference to the prior art cited.

That problem is solved by the crusher bucket according to claim 1.

Preferred features of the invention are defined in the dependent claims.

The present invention has some relevant advantages. The main advantage involves the fact that the bucket has a structure which is particularly suitable for withstanding the stresses resulting from the crushing action.

According to preferred aspects, the present invention also allows adjustment of the crushing effect so as both to be able to adapt to the dimensions of the material to be crushed and to be able to adjust the dimensions of the crushed material.

According to another aspect, the invention also relates to a crusher bucket which comprises a casing, in which there is defined an inlet for the material to be crushed and a discharge for the crushed material, a fixed jaw and a movable jaw, which is connected to the casing by means of at least one eccentric shaft, and a protection plate which is connected to the movable jaw in the region of a support element and which is directed towards the inlet opening, in which the protection plate is connected to the support element by means of an attenuation element so as to allow limited movements for the protection plate with respect to the support portion.

On the basis of that aspect of the invention, it is possible to accompany the material in an optimum manner towards the crushing zone which is interposed between the two jaws, thereby contributing to optimization of the crushing of the material.

Other advantages, features and the methods of use of the present invention will become evident from the following detailed description of some embodiments, which are set out by way of non-limiting example. Reference will be made to the Figures of the drawings, in which.

Figure 1:
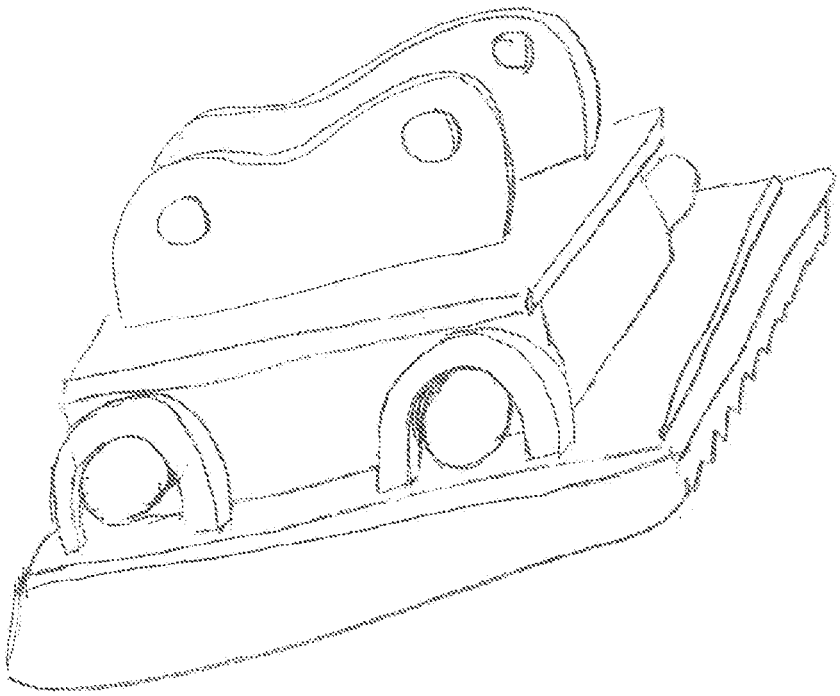
PRIOR ART FIG. 1
FIG. 1 is a schematic illustration of a fixed jaw and the relevant movement system of a crusher bucket which is constructed according to the prior art.
Figure 2:
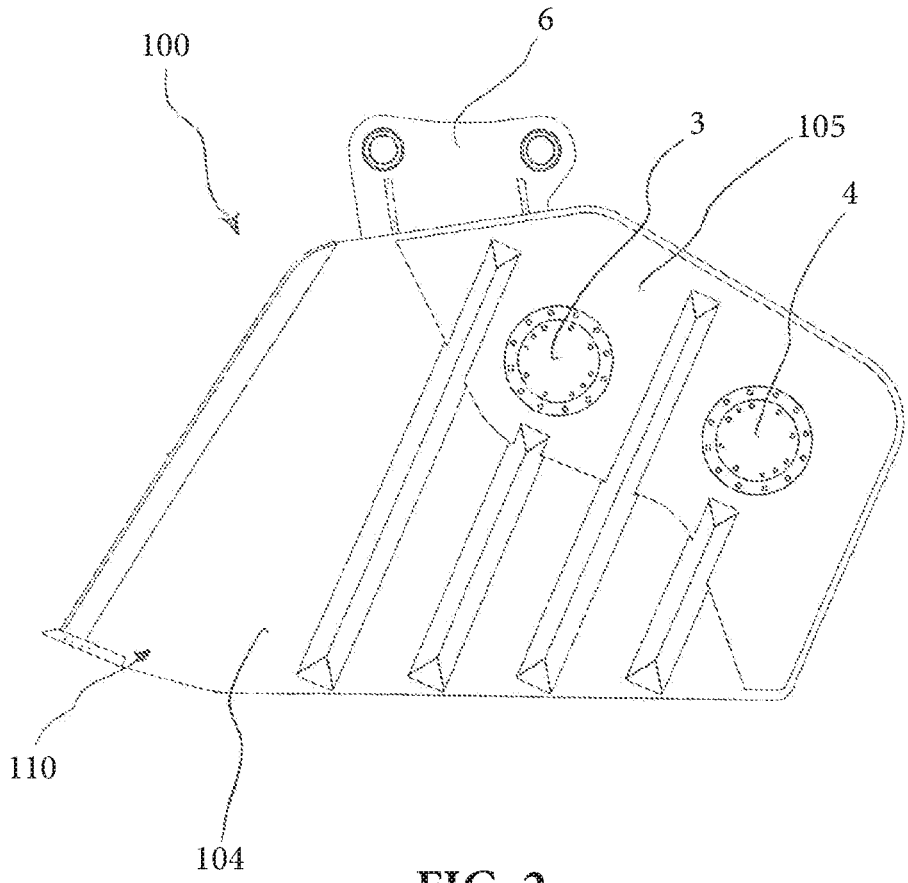
FIG. 2 is a side view of a crusher bucket according to the present invention.

Initially with reference to FIG. 2, a crusher bucket according to the present invention is generally designated 100.

The bucket 100 comprises an outer casing 110 which is preferably spoon-shaped and in which there are provided attachments 6 for engaging the bucket 100 at the free end of an arm of an operating machine (not illustrated).

Figure 3:
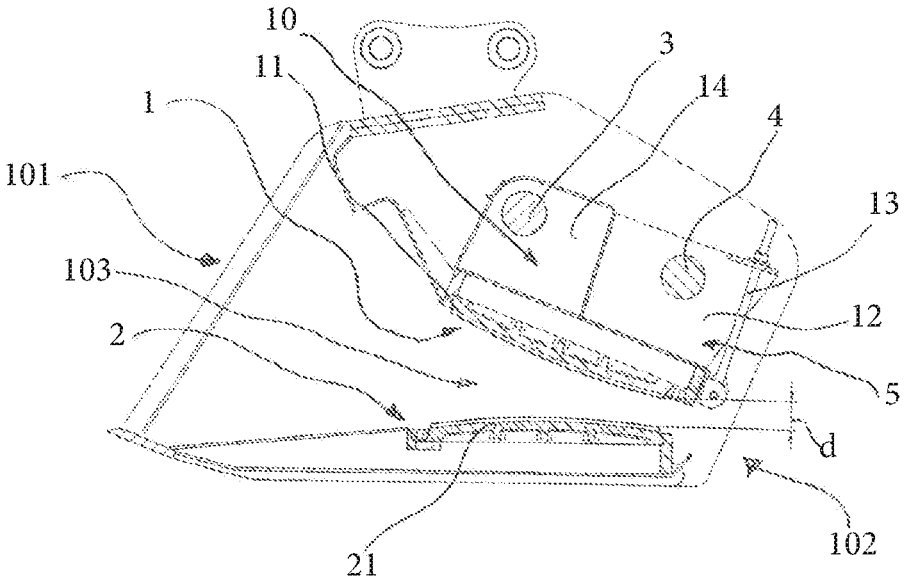
FIG. 3 is a sectioned side view of the crusher bucket of FIG. 2.

There are defined in the casing 110 an inlet 101 for charging crushed stone or other material to be crushed, typically stone material, and an opposite discharge 102 for discharging the processed material, after the crushing operation, which can better be seen in FIG. 3.

There are mounted in the casing 110 elements for crushing the crushed stone, preferably comprising a movable jaw 1 and an opposing fixed jaw 2, which is fixedly joined to the casing 110.

Still with reference to FIG. 3, according to a preferred embodiment, there are removably fixed to the jaws 1 and 2 respective plates 11, 21 which are preferably suitably grooved and which are capable of facilitating the crushing action.

The bucket 100 further comprises a movement device, which is not illustrated in the Figures and which acts on the movable jaw 1 in order to move it away from and towards the fixed jaw 2 in accordance with a suitable trajectory so as to crush the material present between the jaws.

The movement device preferably comprises a pair of eccentric shafts 3, 4 which are supported directly on the side walls 104 of the casing 110 in a rotatable manner in accordance with methods which will be described in greater detail below. The rotation of the eccentric shafts brings about in the movable jaw 1 a pivoting movement in accordance with a quadrilateral linkage mechanism.

The jaws 1 and 2 define inside the bucket 100 a crushing zone 103, which is laterally delimited by the opposing walls 104 of the casing 110 on which the eccentric shafts 3 and 4 are supported.

Figure 10A:
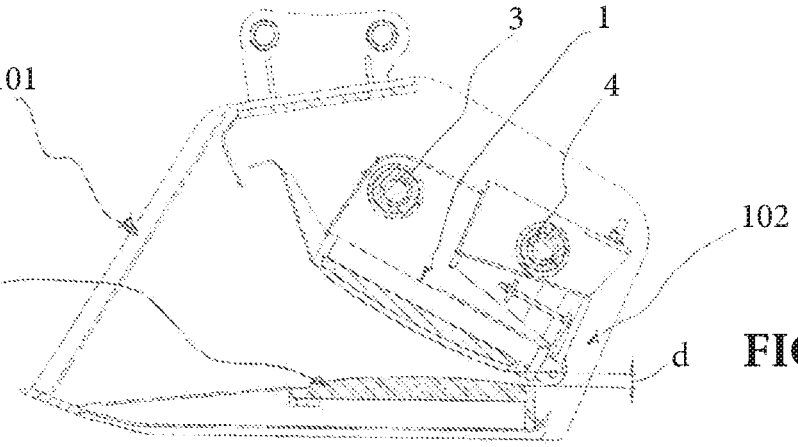
FIGS. 10A and 10B are a lateral section and a perspective view of the crusher bucket of FIGS. 8A, B, respectively, in which the distance between the fixed jaw and the movable jaw has been varied.
Figure 10B:
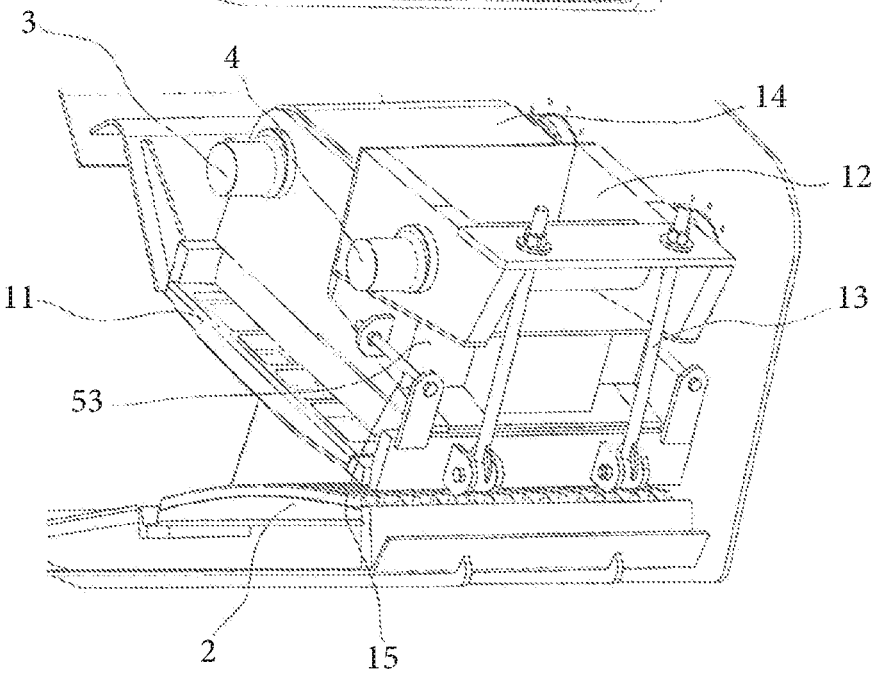
Figure 17:
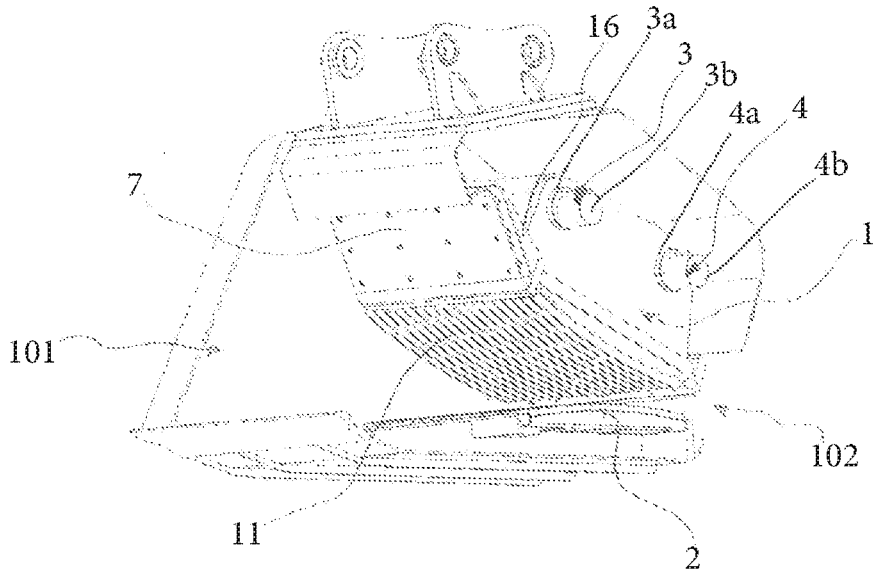
FIG. 17 is a perspective, partially sectioned view which illustrates the bucket of FIG. 14.
Figure 18:
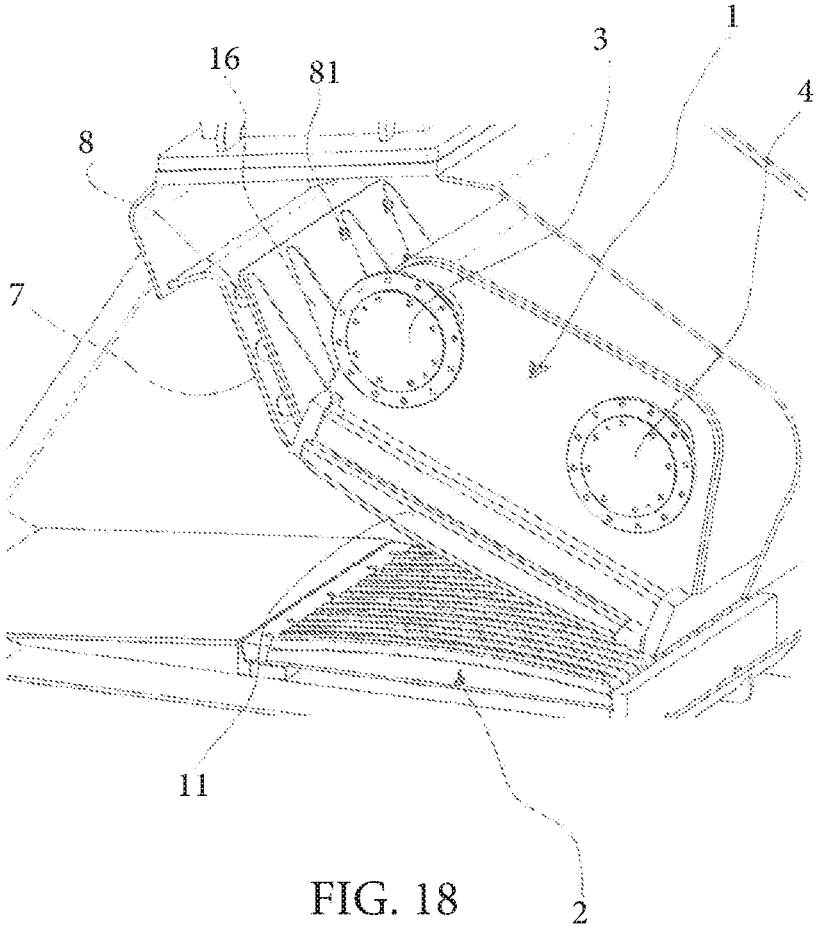
FIG. 18 is a perspective, sectioned view which illustrates a detail of the bucket of FIG. 14.

Preferably, the eccentric shafts 3, 4 comprise a central portion 3*a*, 4*a* and end portions 3*b*, 4*b* which are eccentric with respect to the central portion 3*a*, 4*a*, which can be seen, for example, in FIGS. 10B and 17.

In one embodiment, the movable jaw 1 is supported on the central portion 3*a*, 4*a* and the end portions 3*b*, 4*b* are supported on the opposing walls 104 of the casing 110.

Figure 4A:
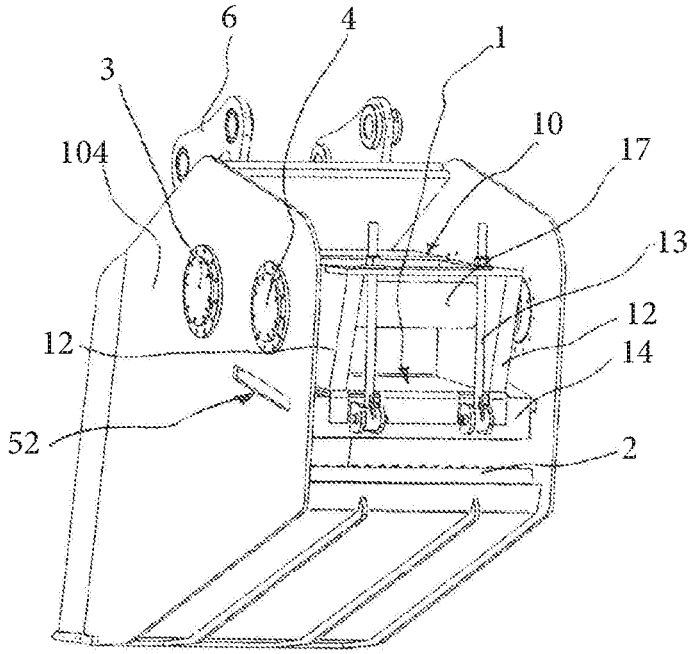
FIGS. 4A and 4B are a perspective view and a relevant detail of the crusher bucket of FIG. 2, respectively.
Figure 4B:
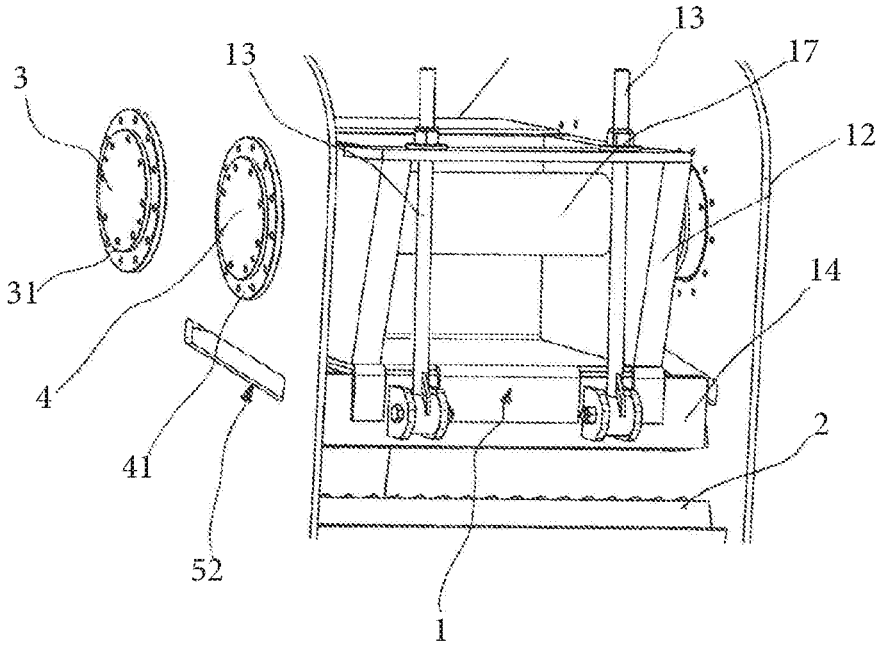

Therefore, with reference to FIGS. 4A and 4B in accordance with a preferred embodiment, the opposite ends of the shafts 3 and 4 are connected to respective bearings, a support ring 31, 41 of which is directly fixed to the walls 104.

Preferably, the rings 31, 41 are fixed to the outer side of the wall 104 in such a manner that the deformation of the casing 110 is limited and the assembly of the structure is facilitated at the same time.

According to a preferred embodiment, the rings 31, 41 extend peripherally to the respective shafts.

Furthermore, preferably, the movable jaw comprises a support portion 10 by means of which it is connected to the shafts 3 and 4.

According to a preferred embodiment, the central portion of each shaft, which is eccentric with respect to the respective ends, is supported in a rotatable manner by means of a metal tube 17.

According to a preferred embodiment, the bucket according to the present invention further comprises an adjustment device 5 for the distance between the fixed jaw and the movable jaw in the region of the discharge 102.

In the present embodiment, the support portion 10 comprises a first portion 14 and a second portion 12 which are connected to the eccentric shaft 3 and the eccentric shaft 4, respectively.

The plate 11 is connected to one of the two portions, preferably the first portion 14. The first portion and second portion are movable relative to each other and, in particular, the lower base of the second portion 12 can be moved away from a respective abutment surface with respect to the first portion 14.

Preferably, the adjustment device 5 comprises one or more spacers and, in this manner, there can be arranged one or more spacers 51 between the first portion and the second portion, thereby moving the rear portion of the movable jaw away with respect to the rear eccentric shaft 4.

Therefore, the distance between the fixed jaw and the movable jaw is consequently varied, in particular in the region of the discharge 102.

Preferably, there is provided at least one adjustment screw 13, two in the present embodiment, which extend(s) between the first portion and the second portion and is engaged in respective portions so as to adjust the distance thereof.

It is in any case evident that the adjustment screw only serves to adjust the distance, the stresses generated by the crushing of the material being transmitted by means of the spacers and supported by the eccentric shafts 3 and 4.

According to a preferred embodiment, the adjustment screws are rotatably connected to the first portion and are engaged by means of a threaded element in the second portion, or vice versa.

Figure 5:
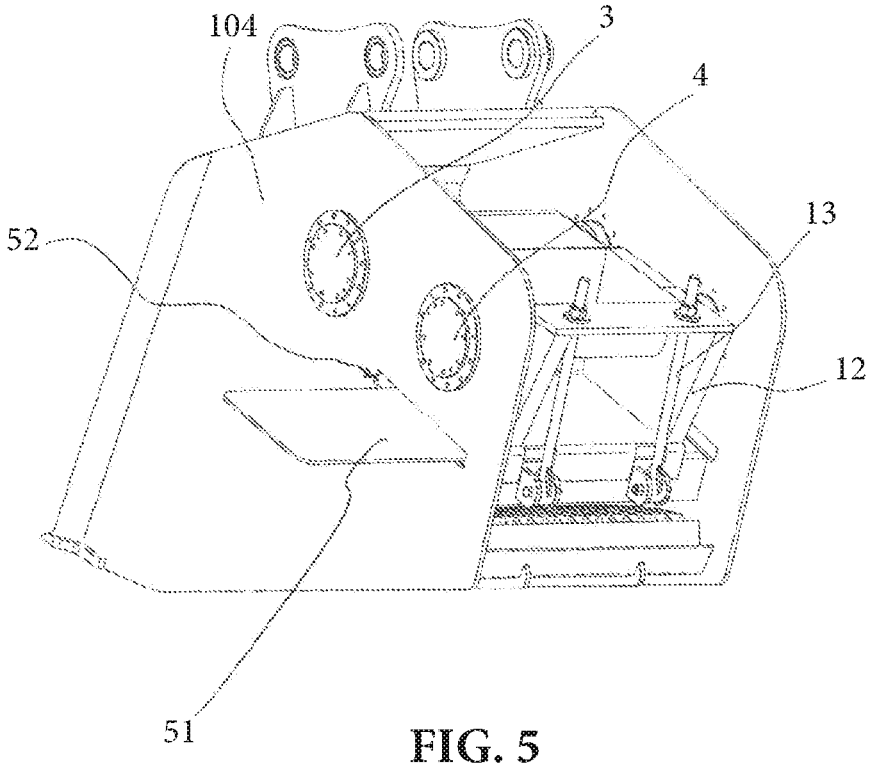
FIG. 5 is a perspective view of the bucket according to the present invention which illustrates the operation for varying the distance between the fixed jaw and the movable jaw.
Figure 6A:
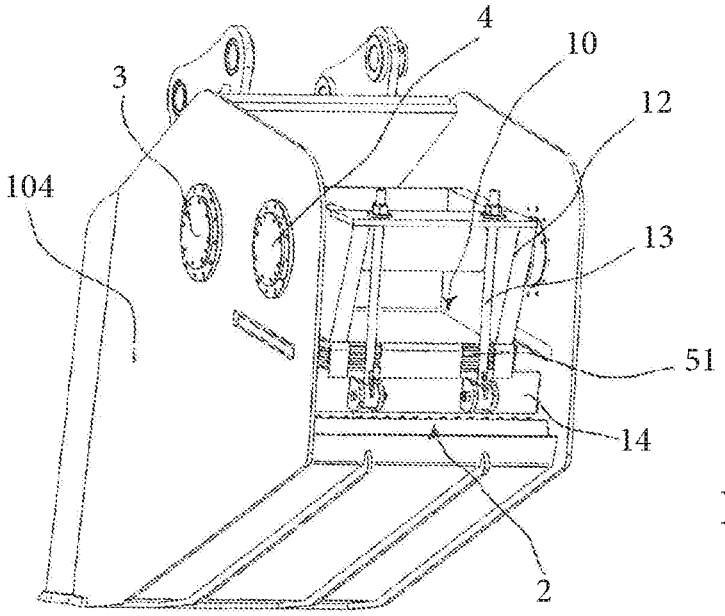
FIGS. 6A and 6B are a perspective view and a relevant detail of the crusher bucket of FIG. 2, respectively, in which the distance between the fixed jaw and the movable jaw has been varied.
Figure 6B:
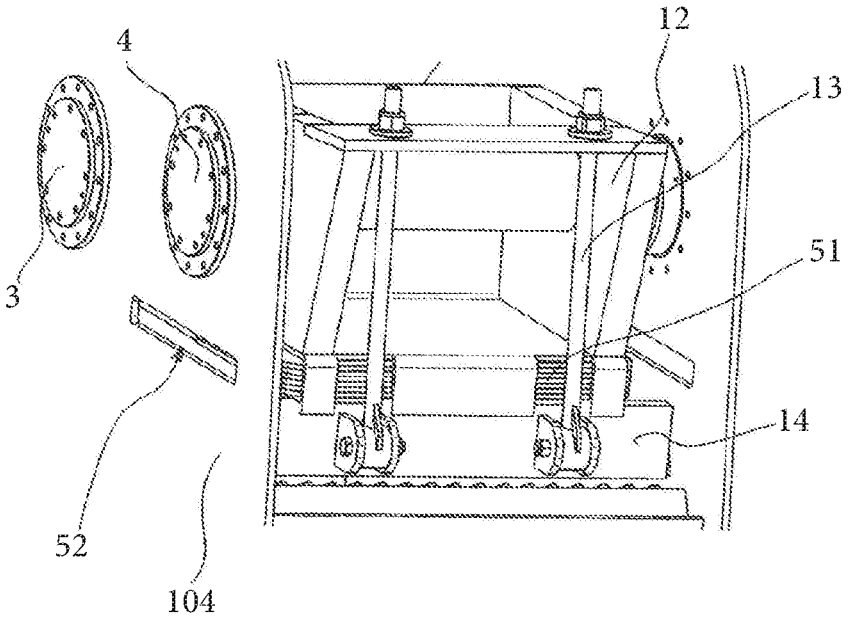
Figure 7A:
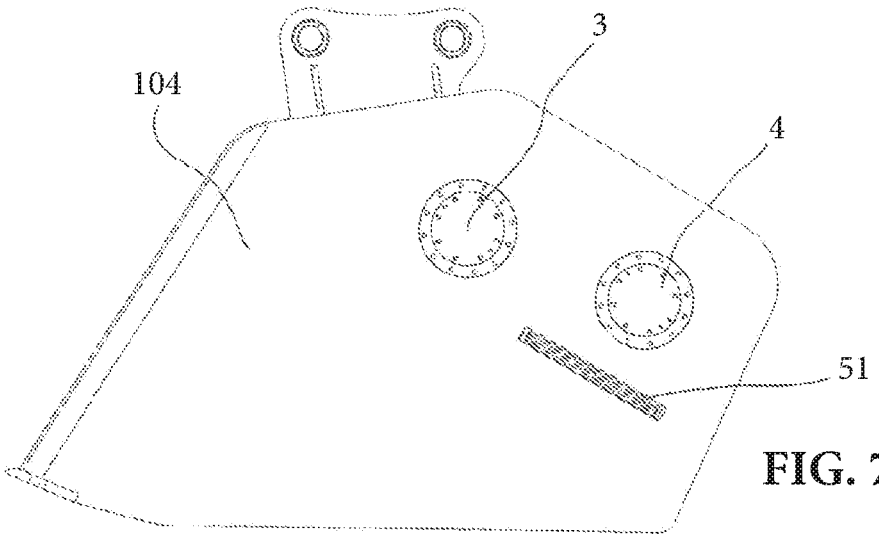
FIGS. 7A and 7B are a side view and a lateral section of the crusher bucket of FIG. 2, respectively, in which the distance between the fixed jaw and the movable jaw has been varied.
Figure 7B:
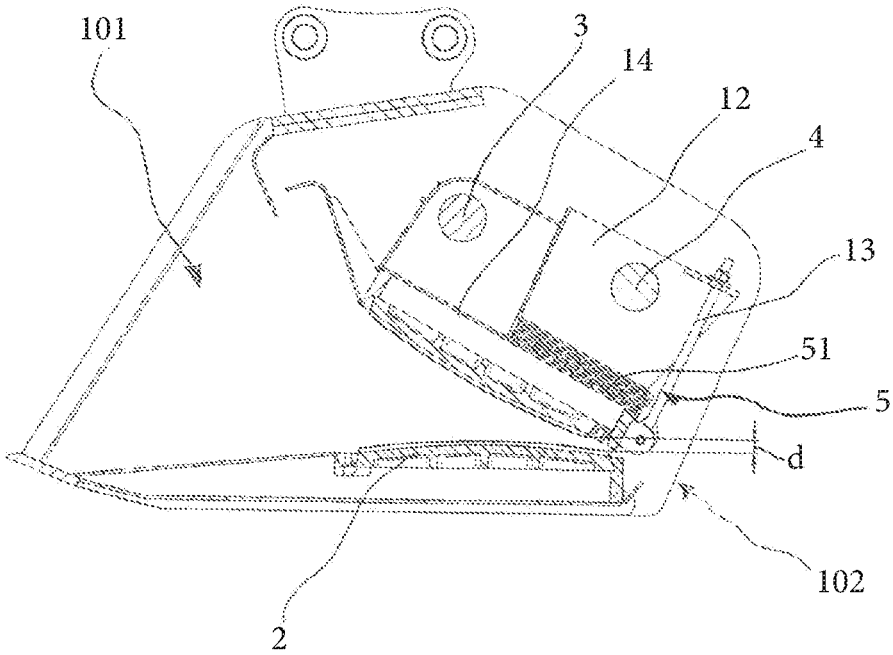
Figure 8A:
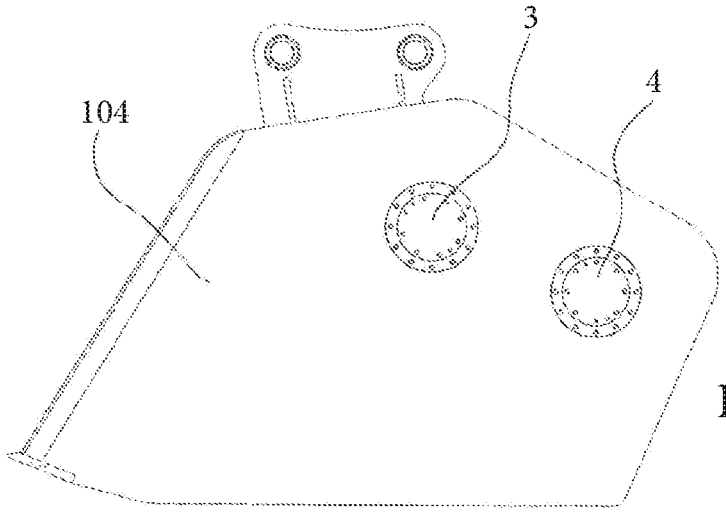
FIGS. 8A and 8B are a side view and a lateral section of a crusher bucket in accordance with a second embodiment, respectively.
Figure 8B:
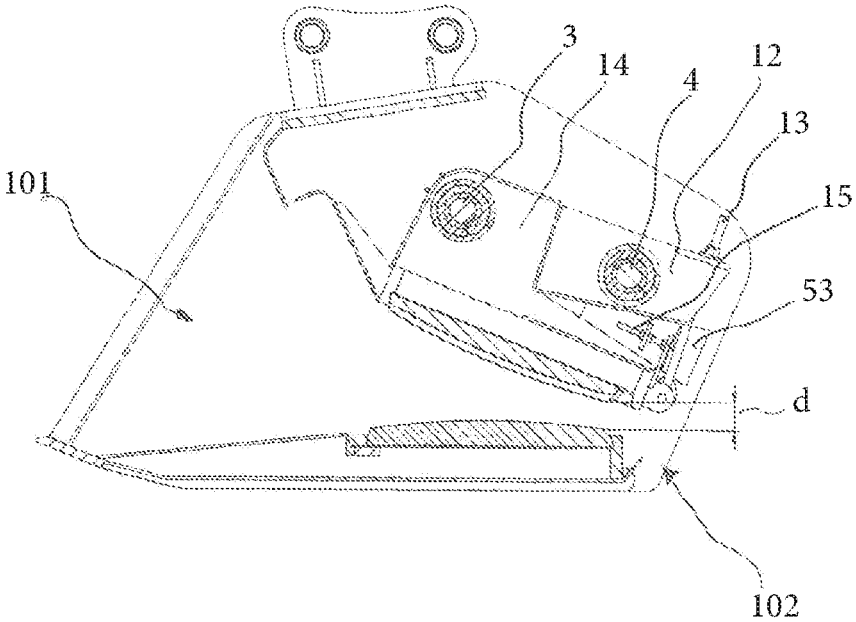
Figure 9A:
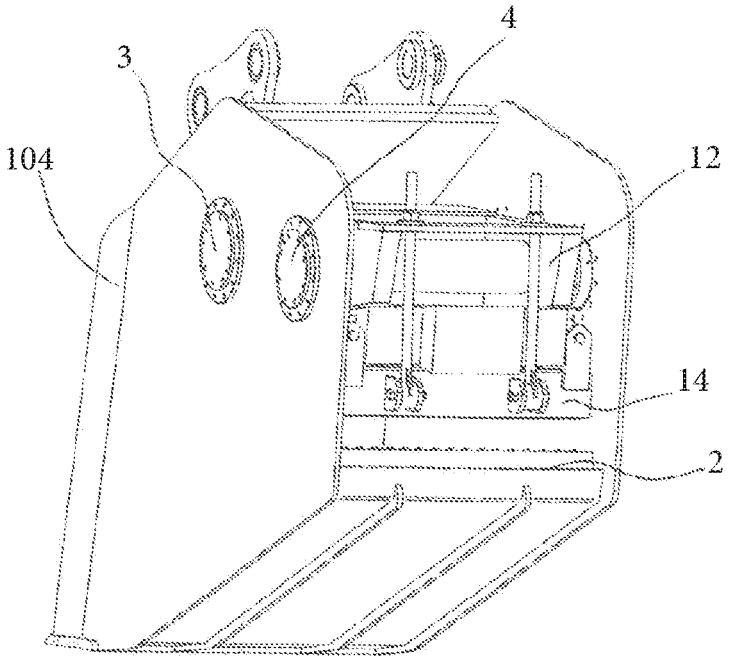
FIGS. 9A and 9B are a perspective view and a relevant detail of the crusher bucket of FIGS. 8A, B, respectively.
Figure 9B:
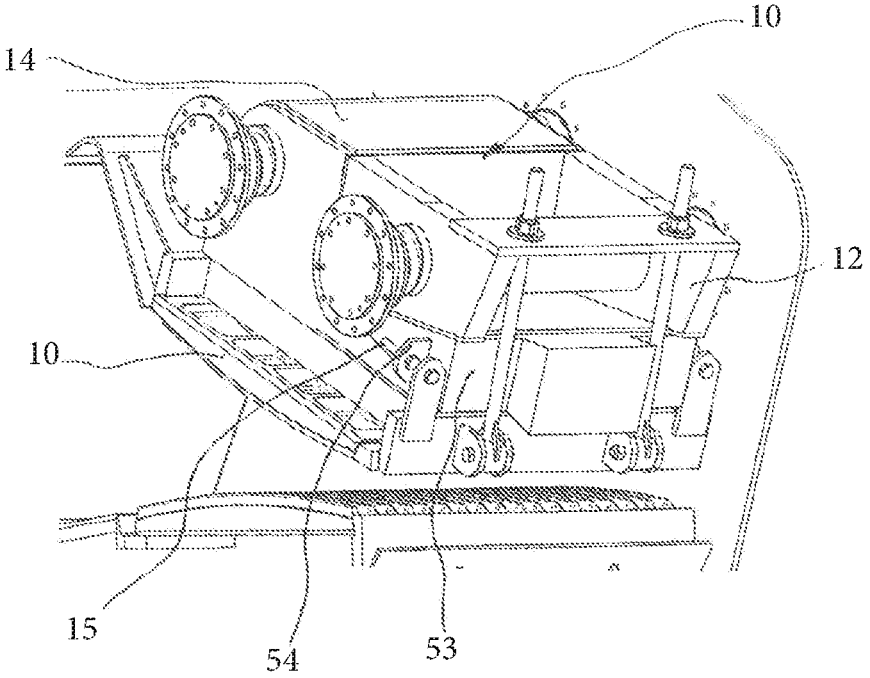

Preferably, there is provided in the wall 104 an opening 52 for the insertion of the spacers 51, as illustrated in FIG. 5.

Again with reference to FIG. 2, the present embodiment also allows the use of lateral reinforcement plates 105, on which there are supported the eccentric shafts 3 and 4 and which cooperate with the wall 104 in order to support the stresses which result from the crushing of the material.

On the basis of an alternative embodiment which is illustrated in FIGS. 8A-10B, the spacer can be produced by means of a wedge-like member 53 which can always be inserted between the two portions of the movable jaw.

In this case, the wedge-like member 53 is preferably inserted in the region of a rear portion of the movable jaw 1.

Furthermore, according to a preferred embodiment, the adjustment device further comprises another adjustment screw 15 which is engaged with the wedge-like member 53 and the first portion 14 of the movable jaw 1, respectively. The screw 15 is orientated in the insertion/withdrawal direction of the wedge-like member 53 and allows the position of the wedge-like member to be adjusted in that direction so as to prevent the tightening of the adjustment screw 13 or the stresses produced by the crushing from causing the wedge-like member 53 to be withdrawn.

Another embodiment is illustrated in FIGS. 11A-13B.

In that present embodiment, one of the two eccentric shafts, mainly the rear eccentric shaft 4, that is to say, the one which is nearest the discharge 102, is supported in a movable manner on the casing 110.

In one type of adjustment, the adjustment device 5 comprises a movable support 54 which is fixed in a movable manner to the side walls 104 of the casing 110, to which there is in turn rotatably connected the rear eccentric shaft 4.

Preferably, the movable support 54 comprises a support plate 54*a*.

In an embodiment, the end portions 3*b*, 4*b* are supported on the side walls 104 by means of the movable support 54.

Figure 12A:
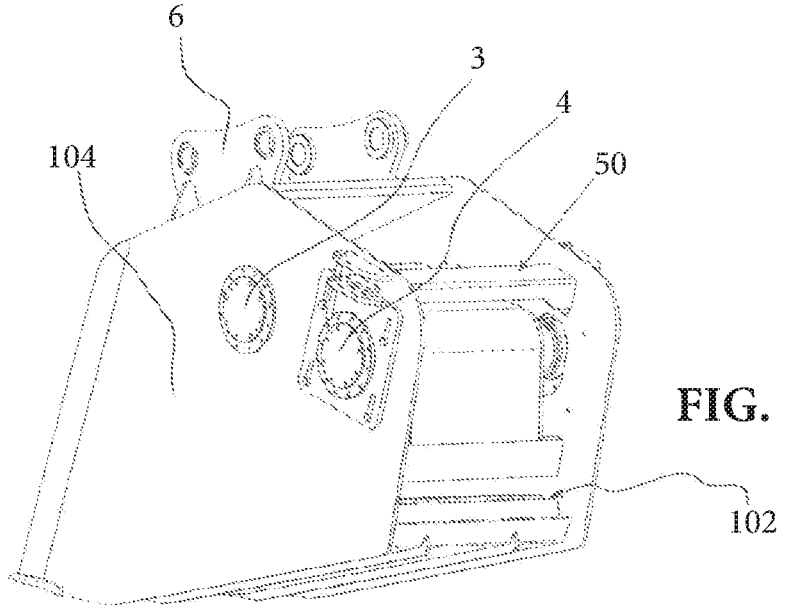
FIGS. 12A and 12B are two perspective views which illustrate the operation for varying the distance between the fixed jaw and the movable jaw in the bucket in accordance with the embodiment of FIG. 11A, B.
Figure 12B:
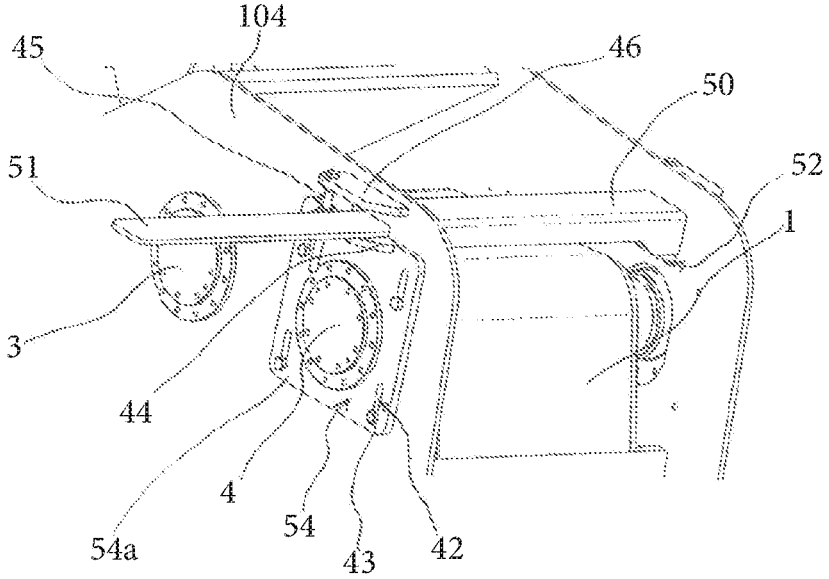
Figure 13B:
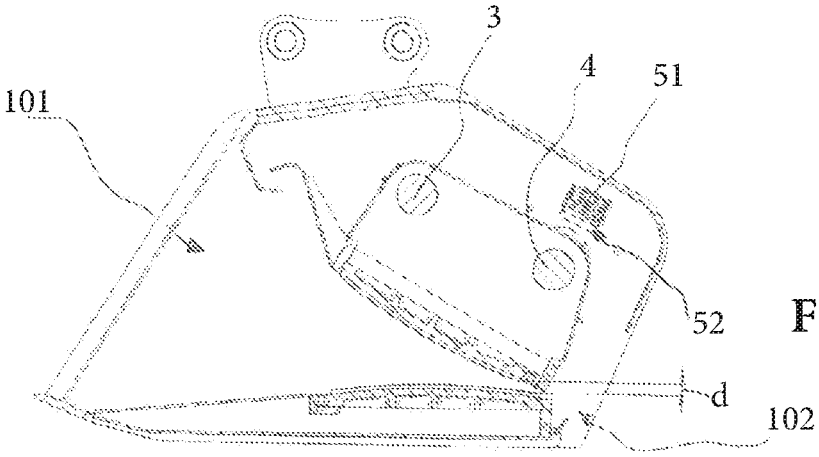
FIGS. 13A and 13B are a side view and a lateral section of the crusher bucket of FIGS. 11A, B, respectively, in which the distance between the fixed jaw and the movable jaw has been varied.
Figure 13A:
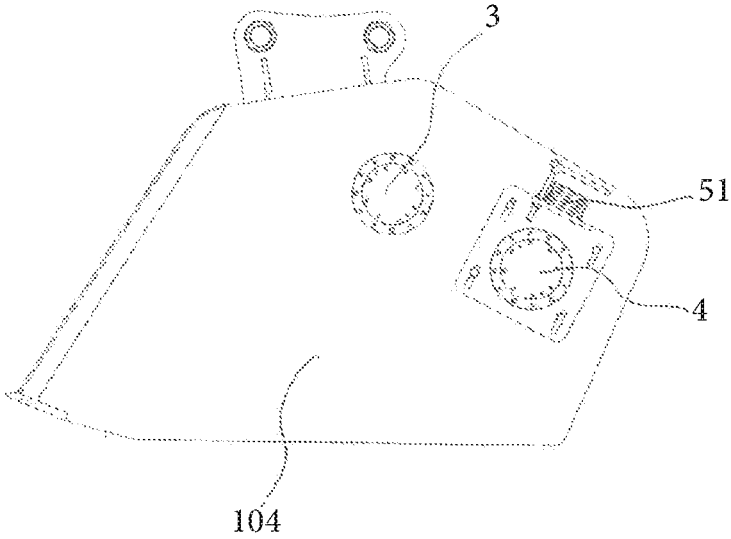
Figure 14:
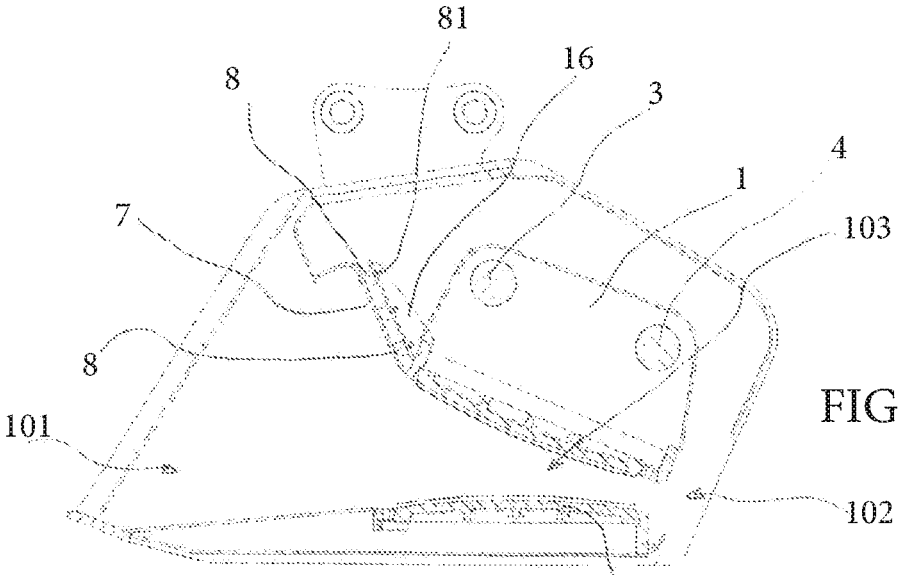
FIG. 14 is a sectioned view of a bucket which is constructed in accordance with another aspect of the present invention.
Figure 15:
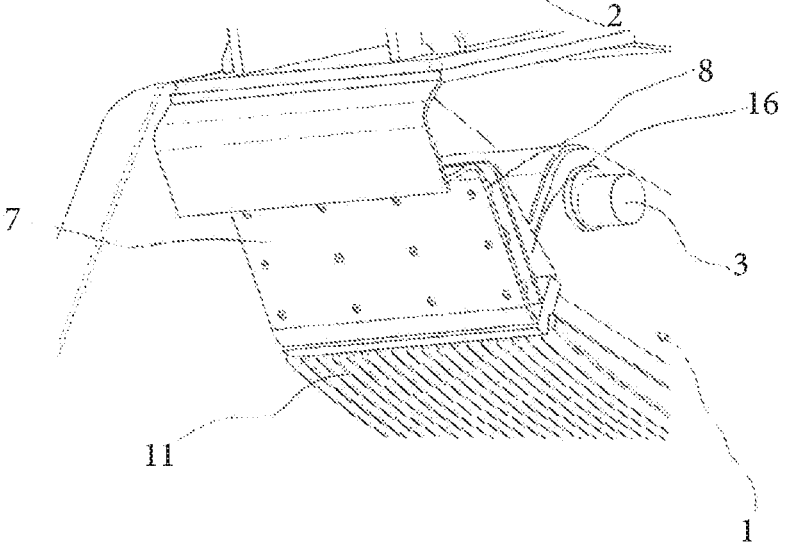
FIG. 15 is a perspective view which illustrates a detail of the bucket of FIG. 14.
Figure 16:
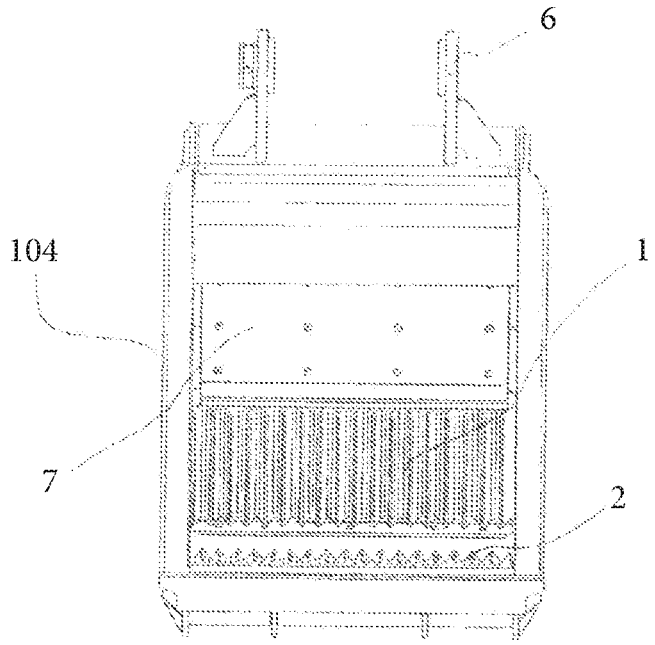
FIG. 16 is a front view of the bucket of FIG. 14.

Now also with reference to FIGS. 12A and 12B, the movable support 54 preferably comprises guides 42, which can slide on respective pins 43 which are connected to the side walls 104. In any case, it is evident that alternatively the pins could be connected to the movable support 54 and the guides could be connected to the side walls.

In this manner, the position of the eccentric shaft 4 can be varied, moving it towards or away from the fixed jaw 2.

The position of the movable support 54 can be fixed in the desired position.

To that end, the adjustment device 5 further comprises at least one spacer which is or can be arranged between an abutment element 50 which is rigidly connected to the casing 110, preferably in the region of the side walls 104, and the movable support.

It should be noted that the abutment element 50 is preferably arranged above the eccentric shaft 4, thereby allowing adjustment of the upper position, that is to say, the position in the direction moving away with respect to the fixed jaw 2.

The abutment element 50 further extends between the two walls 104, being rigidly fixed thereto, thereby also contributing to maintaining the rigidity of the structure.

According to a preferred embodiment, the movable support 54 comprises an extension 44, which is preferably connected to the plate 54*a* and which projects laterally with respect to the surface of the plate 41, which allows the provision of a greater abutment surface for the spacers 51.

However, the position of the eccentric shaft 4 is adjusted in the lower region by means of an adjustment element 45, preferably produced by means of an adjustment screw which is engaged in respective portions of the support 54 and the casing 110. Preferably, the adjustment screw engages with the extension 44 itself and with another extension 46 which is connected to the side wall 104.

According to a preferred embodiment, in order to insert one or more spacers 51 between the support 54 and the abutment element 50, there is/are defined at least one through-opening 52 in the side wall 104.

In this manner, by increasing or decreasing the number of spacers 51 which are arranged between the plate and the abutment element 50 and adjusting the position of the adjustment element 45, it is possible to vary the position of the eccentric shaft 4, adjusting the distance d between the fixed jaw 2 and the movable jaw 1, in particular in the region of the discharge 102.

Figure 11B:
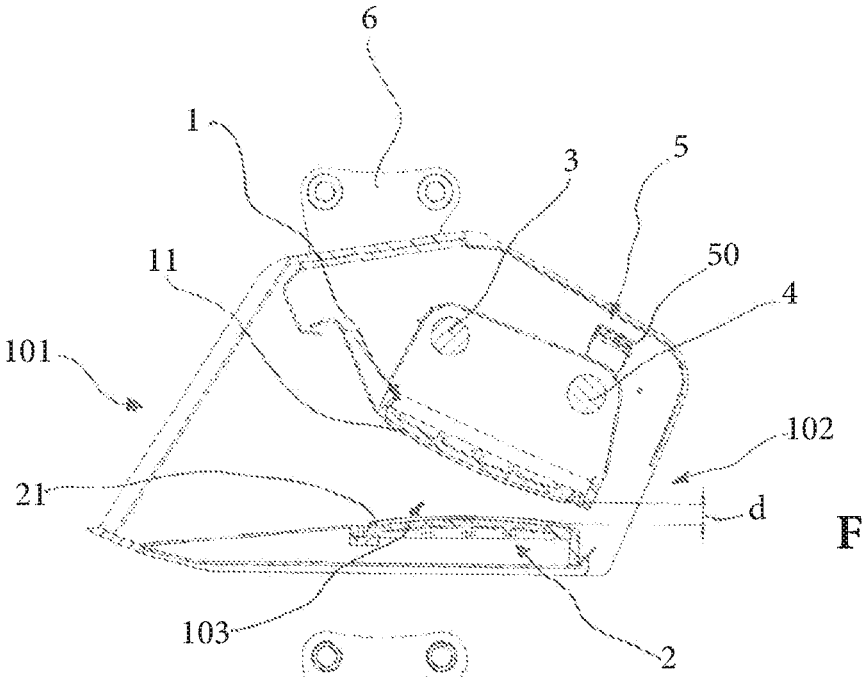
FIGS. 11A and 11B are a side view and a lateral section of a crusher bucket in accordance with another embodiment, respectively.
Figure 11A:
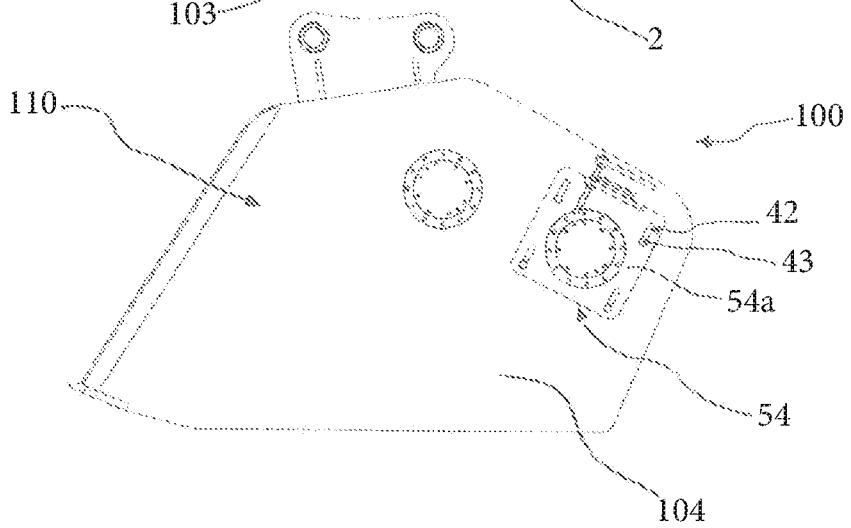

For example, FIGS. 12A and 12B illustrate the operation of the present invention in which, by selecting a greater number of spacers 51, the distance between the fixed jaw 2 and the movable jaw 1 in the region of the discharge 102 is reduced with respect to the distance d of the operating condition of FIG. 11B.

In any case, it is evident that, alternatively to a greater number of spacers, there could also be selected a spacer having different dimensions, obtaining the same technical effect.

Another aspect of the present invention is illustrated in FIGS. 14-18.

The bucket described in those Figures comprises a protection plate 7 which is connected to the movable jaw 1 in the region of a support element 16 and directed towards the inlet 102.

The protection plate 7 is connected to the support element 16 by means of an attenuation element 8 which allows limited movements for the protection plate with respect to the support portion.

For example, the attenuation element 8 is constructed by means of a plurality of cylinders of elastomer material or other material which is partially resilient.

In that embodiment, the protection plate 7 is further connected to the support element 16 by means of a series of screws 81, providing a given play so as not to impede those limited movements which are conferred by the attenuation element 8.

That embodiment further allows simple replacement of the protection plate 7 in the event of wear or damage.

The protection plate 7 is arranged in the region of the inlet 102 and extends as an extension of the movable jaw 7 towards the opening which defines the inlet 102.

In this manner, it is possible to produce an opening having greater dimensions though selecting a jaw having dimensions which are not excessive, given that the front portion of the casing only serves to charge the material, the subsequent crushing zone 103 being provided for the crushing of the material.

The invention thereby achieves the objects set out, further achieving a number of advantages with respect to the prior art involved, including a substantial resistance to the stresses in the crushing steps and a simplicity in terms of the adjustment of the distance between the fixed jaw and movable jaw.

The invention claimed is:

1. A crusher bucket comprising a casing and crushing elements mounted in said casing, said mounted crushing elements consisting essentially of a single fixed jaw and a movable jaw, in which the movable jaw is supported on the casing by a pair of eccentric shafts, wherein the single fixed jaw and the movable jaw define inside the crusher bucket a crushing zone, which is laterally delimited by the opposing side walls of the casing, each side wall defining an inner surface and an outer surface, each surface being perpendicular to an axis of rotation of the eccentric shafts wherein opposite ends of each eccentric shaft are connected to respective bearings, each bearing being directly fixed to the outer surface of the walls of the casing, so as to be integral with said wall, each bearing comprising a support ring extending in a radial direction from the bearing, said support ring defining a planar surface substantially parallel to the outer surface of the walls of the casing, the planar surface being shaped as a closed ring and in contact with the outer surface of the side walls.

2. The crusher bucket according to claim 1, comprising an adjustment device which is capable of varying a distance between the single fixed jaw and the movable jaw at least in the region of a discharge of material.

3. The bucket according to claim 2, wherein the adjustment device comprises one or more spacers.

4. The bucket according to claim 3, wherein the movable jaw comprises a support portion, by means of which it is connected to the shafts, the support portion comprising a first portion and a second portion, the first portion and second portion being movable relative to each other.

5. The bucket according to claim 4, wherein one or more spacers are arrangeable between the first portion and the second portion.

6. The bucket according to claim 2, wherein the adjustment device comprises a wedge member which is positioned or positionable between the eccentric shaft and the movable jaw.

7. The bucket according to claim 6, wherein a support portion comprises a first portion and a second portion, and the wedge member can be inserted between the first portion and the second portion.

8. The bucket according to claim 1, wherein there are defined in the casing an inlet for charging material to be crushed and an opposite discharge for discharging the processed material, the movable jaw is supported by a first eccentric shaft adjacent to the inlet and by a second eccentric shaft adjacent to that discharge.

9. A crusher bucket comprising a casing and crushing elements mounted in said casing said mounted crushing elements consisting essentially of a single fixed jaw and a movable jaw, in which the movable jaw is supported on the casing by a pair of eccentric shafts, wherein the single fixed jaw and the movable jaw define inside the crusher bucket a crushing zone, which is laterally delimited by the opposing side walls of the casing, each side wall defining an inner surface and an outer surf ace, each surf ace being perpendicular to an axis of rotation of the eccentric shafts; the crusher bucket comprising an adjustment device which is capable of varying a distance between the single fixed jaw and the movable jaw at least in a region of discharge of material, the adjustment device comprising one or more spacers, said one or more spacers being arrangeable between an abutment portion and a movable support, the movable support being fixed in a movable manner to the outer surface of the walls and comprising a support plate defining a support surface which is substantially parallel to the outer surface of the walls of the casing, said support plate having a seat suitable for receiving a bearing connected to opposite ends of the at least one of the eccentric shafts.

10. The bucket according to claim 9, wherein each bearing comprises a support ring extending in a radial direction from the bearing, said support ring defining a planar surf ace shaped as a closed ring and substantially parallel to the outer surface of the walls of the casing and to the support surface, the planar surface being shaped as a closed ring.

11. The bucket according to claim 10, wherein the movable support can slide on guides.

12. The bucket according to claim 11, wherein the guides are constructed on the support plate of the movable support.

* * * * *